United States Patent [19]

Ikeura et al.

[11] 4,303,049

[45] Dec. 1, 1981

[54] COARSE AND FINE AIR SUPPLY CONTROL FOR CLOSED-LOOP CONTROLLED CARBURETED INTERNAL COMBUSTION ENGINES

[76] Inventors: Kenji Ikeura, No. 2-1-19, Kubiri, Yokosuka; Masaaki Saito, No. 5-25-11, Iwato, Yokosuka; Michiyoshi Yamane, No. 4-16-4, Hamadayama, Suginami-ku, Tokyo; Hiroshi Sanbuichi, No. 3-5-20, Nakahara, Isogo-ku, Yokohama; Akio Isobe, No. 1-49, Urago-cho, Yokosuka, all of Japan

[21] Appl. No.: 55,396

[22] Filed: Jul. 6, 1979

Related U.S. Application Data

[63] Continuation of Ser. No. 854,218, Nov. 23, 1977, abandoned.

[30] Foreign Application Priority Data

Nov. 30, 1976 [JP] Japan ..... 51/144492

[51] Int. Cl.[3] ..... F02B 33/00; F02M 7/00; F02B 75/10; F02G 3/00

[52] U.S. Cl. ..... 123/440; 123/437; 123/490; 123/445; 123/438

[58] Field of Search ..... 123/119 EC, 32 EA, 32 EE, 123/119 D, 124 B, 490, 437, 438, 440, 445, 489; 60/276, 285

[56] References Cited

U.S. PATENT DOCUMENTS

| | | | |
|---|---|---|---|
| 3,990,411 | 11/1976 | Oberstadt et al. | 123/32 EA |
| 4,046,118 | 9/1977 | Aono | 60/276 |
| 4,075,835 | 2/1978 | Hattori et al. | 123/119 D |
| 4,130,095 | 12/1978 | Bewler et al. | 123/119 EC |
| 4,173,957 | 11/1979 | Hattori et al. | 123/119 EC |
| 4,174,689 | 11/1979 | Hosaka | 123/119 EC |

*Primary Examiner*—Charles J. Myhre
*Assistant Examiner*—R. A. Nelli
*Attorney, Agent, or Firm*—Lane, Aitken, Kice & Kananen

[57] ABSTRACT

In a closed loop air-fuel mixture control system for carburetor-equipped internal combustion engines, an exhaust gas sensor provides a feedback signal to a control unit where the signal is modified to meet the control characteristics of the closed loop. The modified feedback signal is converted into digital pulses whose width varies with the amplitude of the feedback signal. Additional air is supplied to the engine through an air bleed in accordance with the magnitude of the analog feedback signal to provide a coarse control of air-fuel ratio and in response to the digital pulses to provide a fine control of the ratio. The mixture is controlled in a wide range of ratios to eliminate the need for calibration which would be required for fitting the closed loop system to the time-varying characteristics of individual carburetors.

1 Claim, 5 Drawing Figures

COARSE AND FINE AIR SUPPLY CONTROL FOR CLOSED-LOOP CONTROLLED CARBURETED INTERNAL COMBUSTION ENGINES

This is a continuation of application Ser. No. 854,218, filed Nov. 23, 1977, now abandoned.

BACKGROUND OF THE INVENTION

The present invention relates to a closed loop mixture control system for carburetor-equipped internal combustion engines.

The three-way catalyst allows simultaneous conversion of hydrocarbons, carbon monoxide and oxides of nitrogen into harmless wastes. For the catalyst to perform satisfactorily, the engine must have a very closely controlled air-fuel ratio. In fact, a slight offset from the stoichiometric air-fuel ratio can result in a greater reduction in conversion efficiency. A standard carburetor cannot adapt adequately to the variations in engine operation and will thus not give the catalyst the quality of input needed.

To provide precise air-fuel ratio control, a feedback control scheme has been designed for the carburetor using an exhaust gas sensor placed in the exhaust manifold. Whenever the engine is running outside the ideal air-fuel ratio, the gas sensor sends signals to an electronic control unit, which then corrects the fuel-metering system, or carburetor.

However, since the air-fuel ratio varies widely between carburetors because of their different operating characteristics, precise calibration would be required to fit the feedback control loop to the characteristics of each carburetor. Furthermore, since the operating characteristics of the carburetor also vary as a function of aging, such calibration would thus be required at periodic intervals to check if the feedback control is operating satisfactorily.

SUMMARY OF THE INVENTION

The primary object of the present invention is to provide a closed loop mixture control system which is capable of providing a wide control range of air-fuel ratios to eliminate calibration which would be required for fitting the closed loop system to the specific characteristics of each carburetor.

Briefly described, an exhaust gas sensor placed in the exhaust manifold of the carburetor-equipped internal combustion engine provides a first signal representative of the concentration of an exhaust composition of the spent gases to indicate the air-fuel ratio in the exhaust system. The first signal is compared with a reference level representing a desired, or stoichiometric air-fuel ratio to provide a second signal representing the deviation of the air-fuel ratio in the exhaust system from the desired stoichiometric value. The second signal may be modified as necessary to meet the control characteristics of the feedback loop to prevent undesired control oscillation resulting from the varying operating conditions of the engine. The modified control signal is digitalized into pulses whose duration is dependent on the amplitude of the control signal. An auxiliary air supply passage is provided through which additional air is supplied to the engine in accordance with the amplitude of the modified feedback control signal so that the air-fuel ratio is roughly proportional to the feedback signal. The quantity of air is further controlled in response to the digital pulses to provide a fine control of the mixture ratio.

The present invention permits the use of a ruggedly constructed, low cost analog displacement type control valve for the coarse mixture control purpose and the use of a conventional low cost on-off type control valve for the fine mixture control purpose. The coarse and fine control scheme extends the controllable range of air-fuel ratios without introducing rapid variations of air-fuel ratio which would otherwise occur when the size of the on-off valve is simply enlarged.

BRIEF DESCRIPTION OF THE DRAWINGS

The present invention will be further described with reference to the accompanying drawings, in which.

DESCRIPTION OF THE PREFERRED EMBODIMENTS

Figure 1:
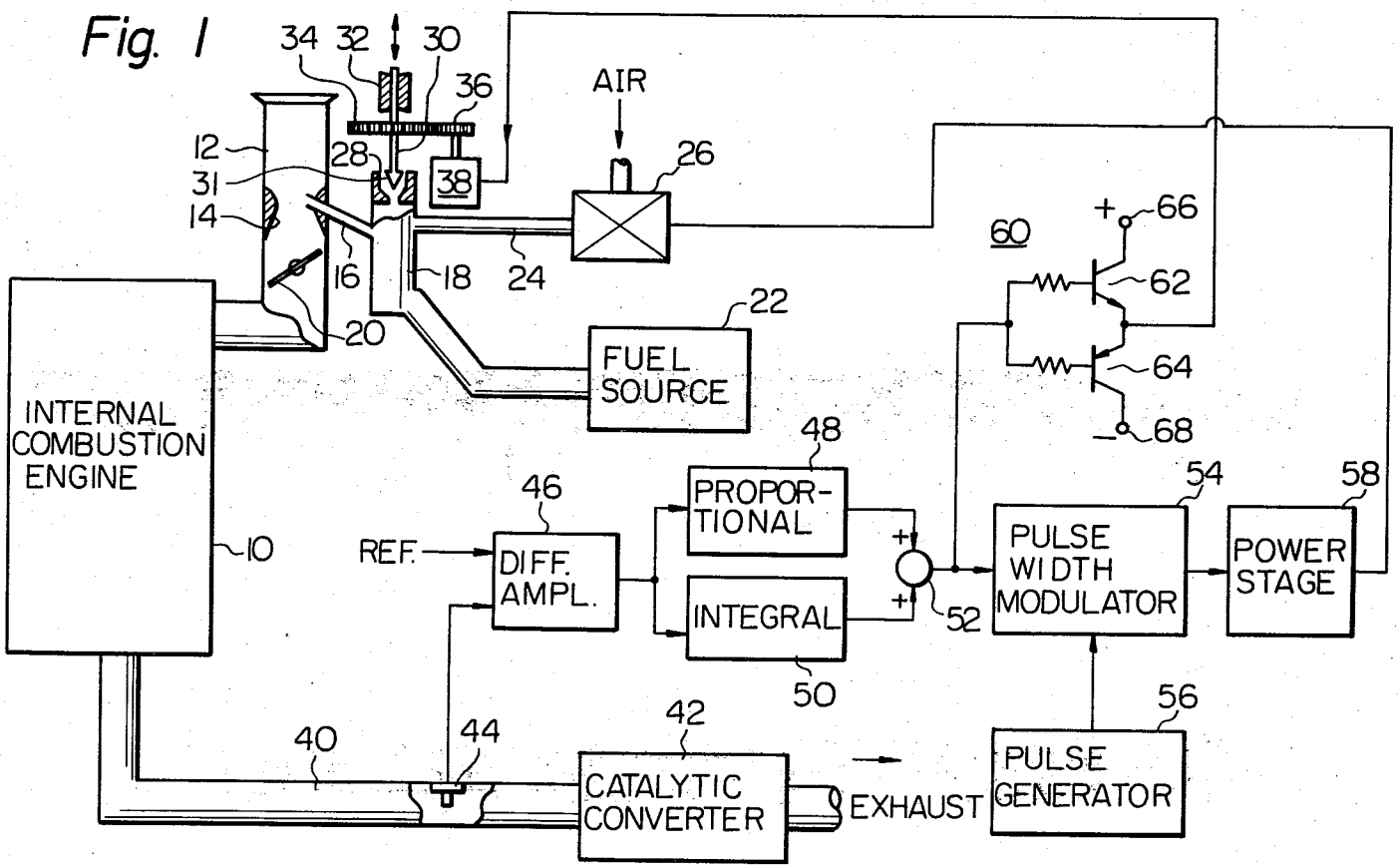
FIG. 1 is a first embodiment of the invention illustrated in the form of a functional block diagram.

In FIG. 1 of the drawings, a first embodiment of the invention is illustrated. The internal combustion engine 10 is supplied with a mixture of air and fuel through an intake manifold 12 which is partly shown as including a venturi 14, a fuel nozzle 16 connected to an air-fuel mixing means 18 and a throttle valve 20. The mixing means or emulsion chamber 18 is connected to a fuel source 22 and to an air supply conduit 24 in which an electromagnetic on-off control valve 26 is disposed. The emulsion chamber 18 is formed at the upper end with an orifice 28 through which a metering needle shaft 30 extends. The needle shaft 30 has a reduced diameter portion 31 at the lower end and is slidably mounted on a suitable bearing 32 and threaded through the center of a gear 34 which is in mesh with a gear 36 mounted on the shaft of a motor 38. The gear 34 is turned by the motor 38 in opposite directions depending on the polarity of an electrical signal applied thereto and moves the air metering rod 30 toward or away from the orifice 28 so as to vary the amount of air additionally inducted therethrough in accordance with the signal applied to the motor 38.

The engine 10 emits spent gases through the exhaust manifold 40 to a catalytic converter 42. Upstream from the catalytic converter 42 the exhaust manifold 40 is provided with an exhaust gas sensor 44, specifically an oxygen sensor, which provides a signal representative of the concentration of oxygen in the exhaust emissions to a differential amplifier 46 for comparision with a reference voltage representing a desired air-fuel ratio to which the air-fuel mixture ratio is controlled. The output from the differential amplifier 46 is a signal representing the deviation of the oxygen concentration from the desired air-fuel ratio, and hence the deviation of the air-fuel ratio within the exhaust system of the engine from the setting point. The signal from the differential amplifier 46 is applied to a control unit including a proportional controller 48 and an integral controller 50 connected together at their input terminals, the outputs of the controllers 48 and 50 being connected to a summation junction or amplifier 52.

The summation output is applied, on the one hand, to a pulse width modulator 54 to which is also applied a train of regularly occurring pulses from a pulse generator 56 to produce a train of rectangular pulses whose width is dependent upon the amplitude of the summation output. After amplification through a power stage 58, the rectangular pulses from the modulator 54 are applied to the air supply control valve 26. The summation output, on the other hand, is applied to a motor drive circuit 60 formed by an NPN transistor 62 and a PNP transistor 64 connected in series between a positive voltage supply 66 and a negative voltage supply 68, the base electrodes of these transistors being connected via respective resistors to the output of the summation amplifier 52. The junction between the transistors 62 and 64 is connected to the motor 38.

With this circuit arrangement, the quantity of air supplied through the control valve 26 is proportional to the width of the pulse determined by the summation output so that the air-fuel ratio is leaned in proportion to the width of the control pulse. When the summation output is positive, the transistor 62 will be biased on to apply the positive terminal 66 to the motor 38 and conversely, a negative summation output will bias the transistor 64 on to apply the negative terminal 68 to the motor 38 so that motor 38 is driven by currents in opposite directions depending on the polarity of the summation output. By the turning of the motor 38 in opposite directions, the metering rod 30 will reciprocate axially by an amount proportional to the magnitude of the summation output so as to vary the cross-sectional area of the orifice 28. Therefore, the air-fuel mixture ratio is controlled continuously in accordance with the summation output.

Although the controllable range can be increased by increasing the control capacity of the valve 26, this is likely to result in an introduction of rapid changes in air-fuel ratio with the consequential loss of control stability. Additional air supply through the orifice 28 provides coarse control of air-fuel ratios with such a ruggedly constructed analog displacement valve as shown in FIG. 1 and serves to increase the controllable range of air-fuel ratios without introducing a loss of control stability to a value not available by the use of a single on-off valve 26. The digital control by the pulse width modulator 54 provides quick response to varying engine operating conditions and permits fine control of air-fuel ratios with an economical on-off control valve 26.

Air supply control through the auxiliary passages 24 and 28 is thus effected simultaneously with analog and digital signals. This analog-digital air supply control not only serves to increase the controllable range of air-fuel ratios, but also provides a rapid response to varying engine loads without the attending loss of control stability.

Figure 2:
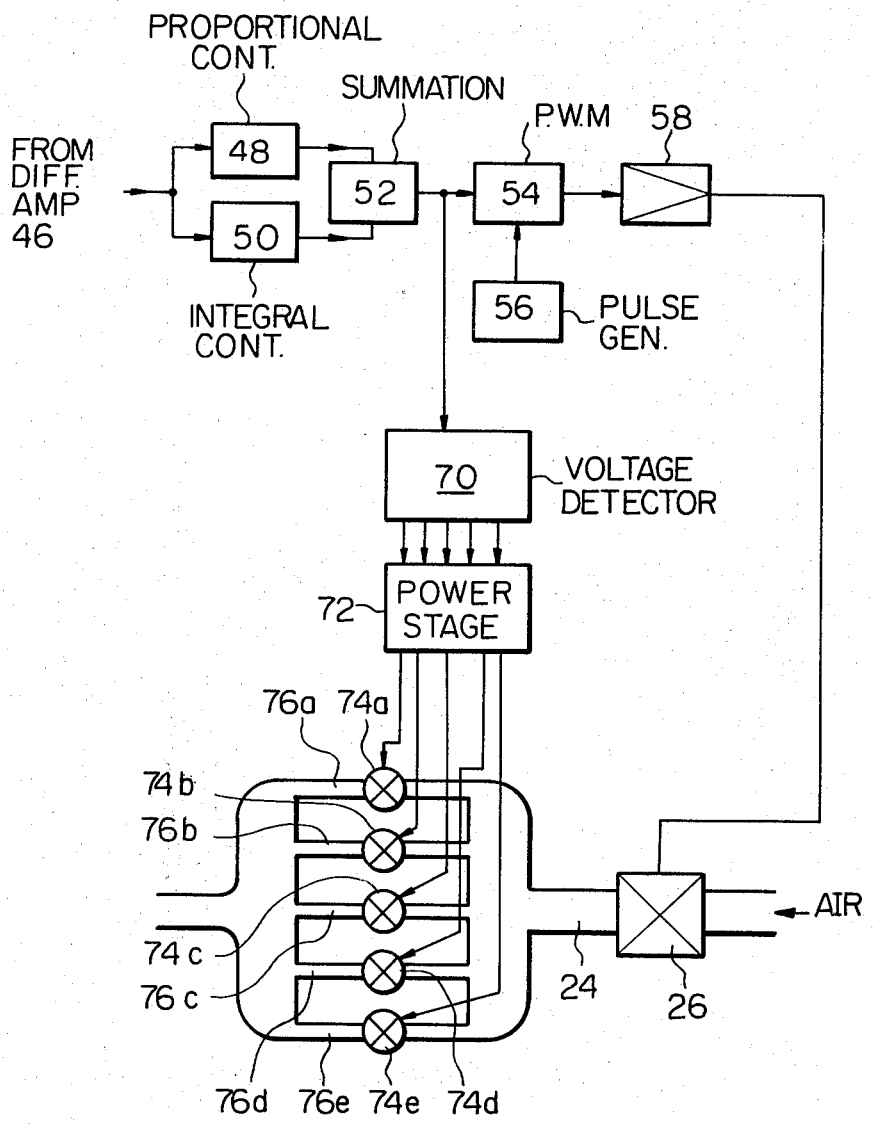
FIG. 2 is a functional block diagram of an alternative embodiment of the invention.

An alternative embodiment is shown in FIG. 2 in which the output from the summation amplifier 52 is connected to a voltage detector 70 which functions to detect various levels of voltage to provide an output in response to the detection of each level to a power stage 72 and thence to a plurality of on-off valves 74*a* through 74*e* disposed in air passages 76*a* through 76*e*, respectively. These air passages are connected in parallel between the downstream side of the control valve 26 and to the inlet of the emulsion chamber 18. The maximum quantity of air supplied to the chamber 18 is obtained when all of the valves 74*a* through 74*e* as well as the control valve 26 are open to their fullest extent. In this embodiment, the amount of air controlled by the valve 26 is proportional to its opening time, whereas the amount of air controlled by valves 74*a* to 74*e* is proportional to the number of valves opened in response to the applied signals. Therefore, valves 74*a* to 74*e*, as a whole, could equally as well be replaced with an analog displacement type valve which can be roughly responsive to the signal directly from the output of the summation amplifier 52.

It will be appreciated therefore that the valves 74*a* to 74*e* provide continuous coarse control of air quantity in accordance with the amplitude of the summation output and determine the maximum controllable range, while the digital control valve 26 provides fine control of air quantity. Therefore, control valves 74*a* to 74*e* and valve 26 as a whole can be considered as an air quantity modulator which provides both amplitude and pulse-width modulations at the same time.

Figure 3:
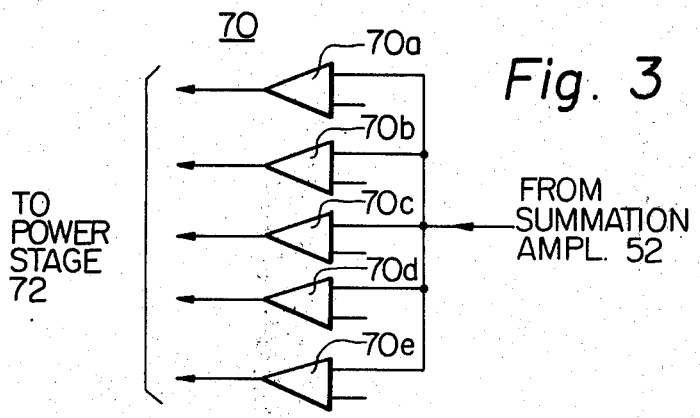
FIG. 3 is a detail of a voltage sensor of the embodiment of FIG. 2.

As shown in FIG. 3 the voltage detector 70 is comprised of a plurality of comparators 70*a* through 70*e* each having a first input terminal connected to the output of the summation amplifier 52 and a second input terminal connected to a respective voltage source (not shown) of such a value that an output is delivered in succession from the comparators 70*a* to 70*e* when each reference voltage is reached in the respective comparators as the input voltage increases.

Figure 4:
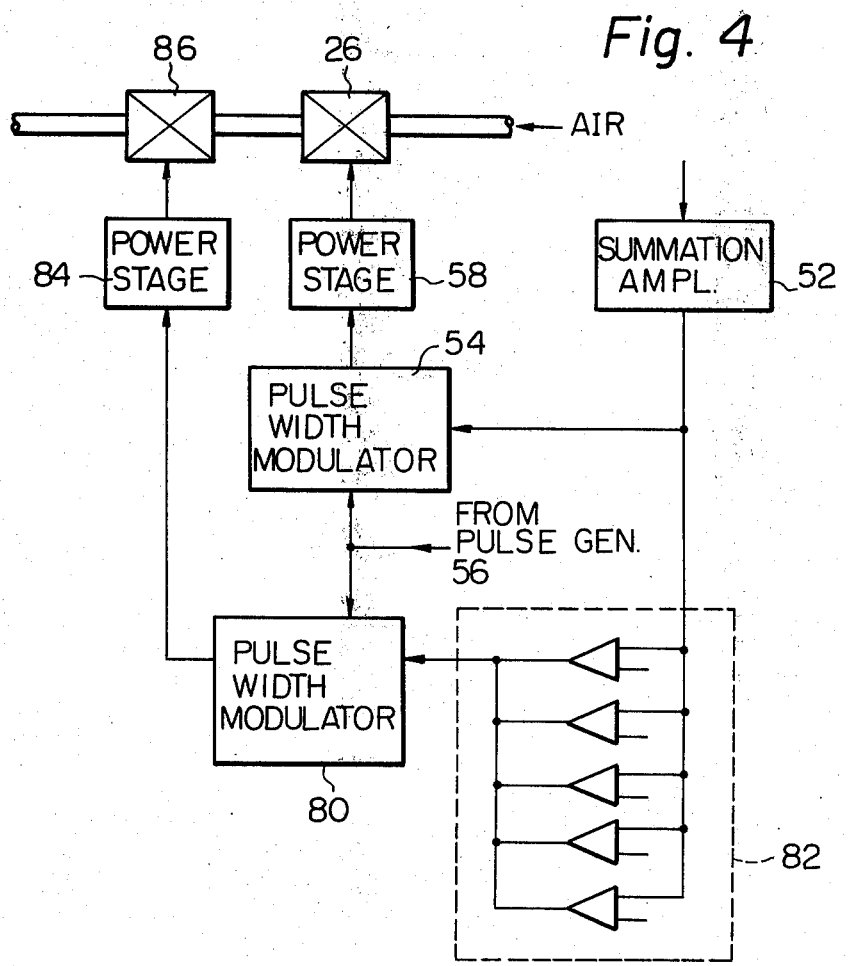
FIG. 4 is a functional block diagram of a modification of the embodiment of FIG. 2.

Another modification of the embodiment of FIG. 2 is illustrated in FIG. 4 in which an additional pulse width modulator 80 is provided to receive signals from a voltage detector 82 of a generally similar construction to that of the detector 70. The voltage detector 82 receives its input signal from the summation amplifier 52 to provide an output whose amplitude varies stepwisely in response to each of the predetermined various voltage levels being detected. The pulse width modulator 80 converts the staircase-like output from the voltage detector 82 into a train of pulses in the same manner as is done in the modulator 54, which pulses are applied via a power stage 84 to an on-off electromagnetic valve 86 disposed in the passage 24 in series with the control valve 26. The valve 86 provides a coarse air supply control in stages, while the valve 26 provides a fine air supply control.

Figure 5:
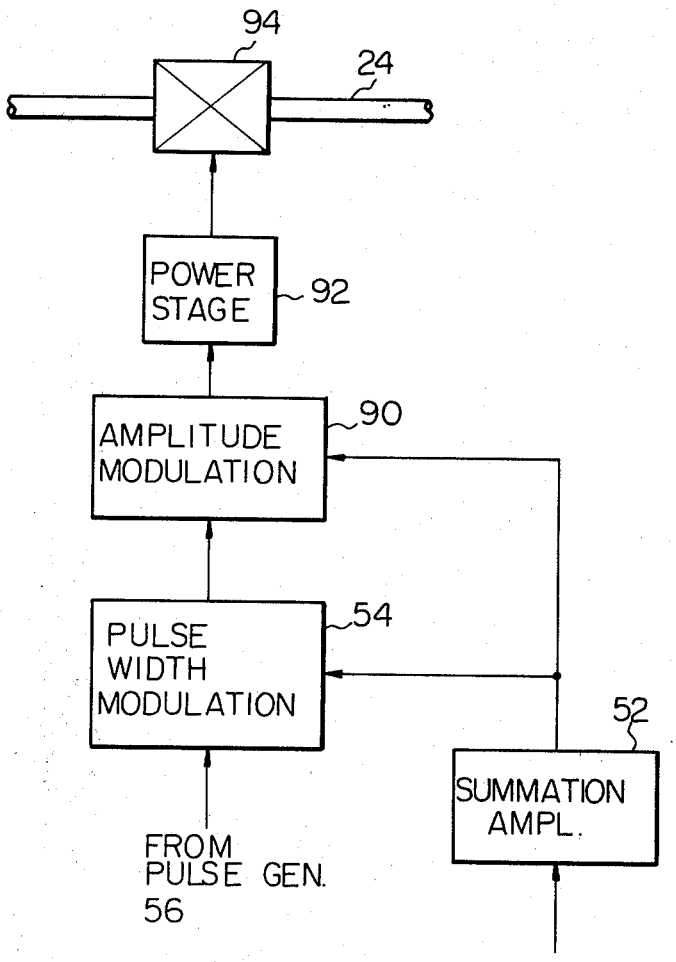
FIG. 5 is a block diagram of a further modification of the invention.

A further modification of the embodiment of FIG. 2 is shown in FIG. 5 in which the output of the summation amplifier 52 is supplied to an amplitude modulator 90 as well as to the pulse width modulator 54. The amplitude modulator 90 is interposed between the output of the pulse width modulator 54 and a power stage 92 which drives a control valve 94. In this circuit arrangement, the amplitude of the pulses from the modulator 54 is modulated in accordance with the summation output so that the input to the power stage 92 is the amplitude-and-pulse-width modulated signal. The control valve 94 is of a conventional on-off type which is normally designed to open for the duration of input pulse and close during the interval between successive pulses.

The on-off control valve, however, has a tendency to become slow in responding to the leading and trailing edges of the applied pulse. The response time is inversely proportional to the amplitude of the input pulse such that, for the input pulses of lower amplitude, the next pulse may occur before the valve reaches its closed position and thus the air quantity will reduce in proportion to the magnitude of the input pulse. Therefore it will be appreciated that the simultaneous application of the amplitude-modulated signal and the pulse-width modulated pulse to the on-off control valve 94 will cause it to open in proportion to the amplitude-modulated signal while the open time is proportional to the width of the applied pulse.

What is claimed is:

1. A closed loop mixture control system for an internal combustion engine, comprising:

a fuel source;

means defining an intake passage provided with a venturi and a throttle valve disposed downstream of said venturi, said intake passage communicable with the internal combustion engine to supply a combustible mixture;

an emulsion chamber communicating with said fuel source to receive fuel therefrom and with the atmosphere to receive air whereby fuel and air in said emulsion chamber are mixed to provide an air-fuel mixture;

a fuel nozzle extending from said emulsion chamber to open into said intake passage to supply said air-fuel mixture in said emulsion chamber into said intake passage;

means defining an exhaust passage communicable with the internal combustion engine to receive exhaust gases therefrom;

a first electromagnetic ON-OFF control valve arranged to control air flow communication between said emulsion chamber and the atmosphere;

means for controlling air flow communication between said emulsion chamber and the atmosphere, said air flow controlling means includes a metering needle arranged to cooperate with an orifice opening into said emulsion chamber, and an electric motor for actuating said metering needle in one direction when it is biased in one direction and for actuating said metering needle in the opposite direction when it is biased in the opposite direction;

an exhaust gas sensor provided to detect concentration of a component of the exhaust gas to generate a sensor signal representative of said concentration of said component of the exhaust gas;

a differential amplifier having an input connected to said exhaust gas sensor to receive said sensor signal to generate at its output a deviation signal representative of a difference between said sensor signal and a reference signal;

a proportional controller having an input connected to said output of said differential amplifier to receive said deviation signal to modify the amplitude of said deviation signal with a proportionality factor to provide at its output a proportional signal;

an integral controller having an input connected to said output of said differential amplifier to receive said deviation signal to provide time integration of said deviation signal with a predetermined integration rate to provide at its output an integration signal;

a summation junction connected to said outputs of said integral controller and said proportional controller and which provides a summation signal representative of summation of said proportional signal and said integral signal;

a pulse width modulator connected to said summation junction to generate at its output a train of pulses, each of which has a width representative of said summation signal;

means for actuating said electromagnetic ON-OFF control valve in response to said train of pulses; and control means connected to said summation junction to receive said summation signal for actuating said air flow controlling means in response to said summation signal, said control means includes two power stages with their control inputs connected to said summation junction to receive said summation signal and arranged with respect to said electric motor to bias said motor in one direction when said summation signal is positive and to bias said electric motor in said opposite direction when said summation signal is negative.

* * * * *